US006402275B1

(12) United States Patent
Yang

(10) Patent No.: US 6,402,275 B1
(45) Date of Patent: Jun. 11, 2002

(54) DETACHABLE DRAWER RAIL

(76) Inventor: Jun-Long Yang, No. 33, Da-Hsin 15 St., Tai-Ping City, Taichung Hsien (TW)

( * ) Notice: Subject to any disclaimer, the term of this patent is extended or adjusted under 35 U.S.C. 154(b) by 0 days.

(21) Appl. No.: 09/962,766

(22) Filed: Sep. 25, 2001

(51) Int. Cl.[7] ..... A47B 88/04

(52) U.S. Cl. ..... 312/334.46; 312/334.44; 312/333

(58) Field of Search ..... 312/334.1, 334.44, 312/334.46, 334.47, 330.1, 333, 334.11, 334.7, 334.8; 384/18, 21, 22

(56) References Cited

U.S. PATENT DOCUMENTS 4,932,792 A * 6/1990 Baxter ..... 312/334.46 X
5,181,782 A * 1/1993 Wojcik ..... 312/334.44 X
5,577,821 A * 11/1996 Chu ..... 312/334.11
6,244,678 B1 * 6/2001 Dopp et al. ..... 312/333
6,257,683 B1 * 7/2001 Yang ..... 312/333

* cited by examiner

*Primary Examiner*—James O. Hansen
(74) *Attorney, Agent, or Firm*—Pearne & Gordon LLP

(57) ABSTRACT

A detachable drawer rail includes a track (10), a rail (20) slidably mounted on the track (10) and a resilient latch (30) secured on the rail (20). The resilient latch (40) is composed of two resilient ears (36) which make the rail (20) operated easily and also have excellent positioning efficiency. Additionally, the resilient latch (30) further has a nub (34) with an abutment face (341) and a groove (38) defined therein to mate with a recess (262) and a tongue (28) of the rail (20) respectively to make the resilient latch (30) firm and steady when used.

6 Claims, 11 Drawing Sheets

DETACHABLE DRAWER RAIL

BACKGROUND OF THE INVENTION

1. Field of the Invention

The present invention relates to a detachable drawer rail, and more particularly to a detachable drawer rail having a retaining device.

2. Description of Related Art

Detachable drawer rails are normally used with drawers or keyboard racks of computer desks and are mounted on side faces of the drawers or similar features to mount the drawer or rack in a desk. Multiple conventional detachable drawer rails are usually composed of a ball bearing race slidably mounted between an intermediate track and an inner rail so that the drawers can be easily removed. Additionally, retaining devices are secured on the detachable drawer rails to keep the drawers limited within a sliding range and to retain the drawers in a certain position when the drawer is pulled out of a desk.

There are several types of conventional detachable drawer rail available at present. For example with reference to FIGS. 6, 7 and 8, a first conventional detachable drawer rail and with reference to FIGS. 9, 10, and 11, a second conventional detachable drawer rail, both comprise a track (60), a rail (70) slidably mounted in the track (60) and a resilient plate (90) attached to the rail (70). The first and second conventional detachable drawer rails further comprise a bearing race (80) mounted between the track (60) and the rail (70) to make the rail (70) slide more easily in the track (60).

Now referring to FIGS. 6–8 of the first conventional detachable drawer rail, the track (60) is adapted to be fixed to an inner face of a compartment of a furniture item and has a limit tab (64) secured on one end of the track (60) to avoid the bearing race (80) falling from the track (60). The track (60) further has a limit block (66) with two locking protrusions (662) secured on the other end of the track (60) to prevent the rail (70) completely sliding out of the furniture item.

The rail (70) is adapted to be secured to a side-wall of a drawer and has an opening (72) defined in a middle portion of the rail (70). An attachment hook (74) and a locking block (76) are formed on one side and the other side of the rail (70) near the opening (72) respectively. A recess (762) is defined in the rail (70) near a base of the locking block (76).

The resilient plate (90) is flexible and has a front fork (92) formed at one end of the resilient plate (90) to be jammed with the attachment hook (74) of the rail (70). The resilient plate (90) has a round bottom nose (94) embossed under a bottom side of the resilient plate (90) to wedge into the recess (762) of the rail (70). Therefore, the resilient plate (90) is detachably secured on the rail (70).

Now referring to FIG. 8, when the drawer is pulled outwardly, the locking protrusion (662) blocks the resilient plate (90) at one vertical retaining flat (666) so as to efficiently prevent the drawer from being completely pulled out of the compartment of the furniture item. When the drawer is released, the resilient plate (90) is pressed toward to the rail (70) to make the resilient plate (90) have no contact with the retaining flat (666) and then the engagement of the rail (70) and the track (60) is released.

However, when users press the resilient plate (90), fingers often are stained with lubrication coated on elements of the retaining device. Additionally, the round bottom nose (94) of the resilient plate (90) is easily rocked inside the recess (72) so as to make the whole retaining device unstable in use.

As to the second conventional detachable drawer rail as shown in FIGS. 9–11, the track (60) is adapted to be fixed to an inner face of a compartment of a furniture item and has a limit tab (64) secured on one end of the track (60) to avoid the bearing race (80) falling from the track (60). The track (60) further has a limit block (66) with two locking protrusions (662) secured on the other end of the track (60) to prevent the rail (70) completely sliding out of the compartment of the furniture item.

The rail (70) is adapted to be secured to the side-wall of the drawer and has an opening (72) defined in a middle portion of the rail (70). A lip (71) is formed on the rail (70) near the opening (72) and a hole (73) is defined in the rail near the opening (72) at an opposite side to the lip (71).

The resilient plate (90) is flexible and has a tab (91) formed at one end of the resilient plate (90) to be jammed with the lip (74) of the rail (70). The resilient plate (90) further has a through hole (93) defined in the other end of the resilient plate (90). The through hole (93) corresponds to the hole (73) of the rail (70) and a pin (931) penetrates the through hole (93) and the hole (73) so as to make the resilient plate (90) detachably and firmly secured on the rail (70). Additionally, two ports (95) are defined respectively in opposite edges of a middle portion of the resilient plate (90).

Now referring to FIGS. 10 and 11, when the drawer is being pulled outwardly, the resilient plate (90) is pressed downwardly by resisting the locking protrusions (662) of the limit block (66). Then, the drawer is stopped when the locking protrusions (622) are retained inside the port (95) of the resilient plate (90) as shown in FIG. 11. A pushing end (961) urging against the locking protrusions (622) comprises a guiding arc (963) so that when the drawer is pushed hard a little, the guiding arc (963) makes the locking protrusion (662) released from the port (95). Then, the drawer is able to retract in the compartment of the furniture item.

Therefore, the shape of the guiding arc (963) is important, and especially in its precise angle. When the angle is overly curved, the limit block (66) loses its positioning function and the drawer is excessively movable. On the contrary, when the angle is not curved enough, the drawer is not easily pushed back to the compartment by the users. Besides, a pushing force to overcome the resilient plate (90) by the guiding arc (963) works axially so that the resilient plate (90) itself is easily broken in the middle portion and other places, especially the tab (92).

To overcome the shortcomings of these two conventional detachable drawer rails, the present invention provides a detachable drawer rail to mitigate and obviate the aforementioned problems.

SUMMARY OF THE INVENTION

A first objective of the invention is to provide a detachable drawer rail that is easy to operate and has excellent positioning efficiency.

A second objective of the invention is to provide a detachable drawer rail that is firm and steady when being used.

Other objects, advantages and novel features of the invention will become more apparent from the following detailed description when taken in conjunction with the accompanying drawings.

DETAILED DESCRIPTION OF THE PREFERRED EMBODIMENT

Figure 1:
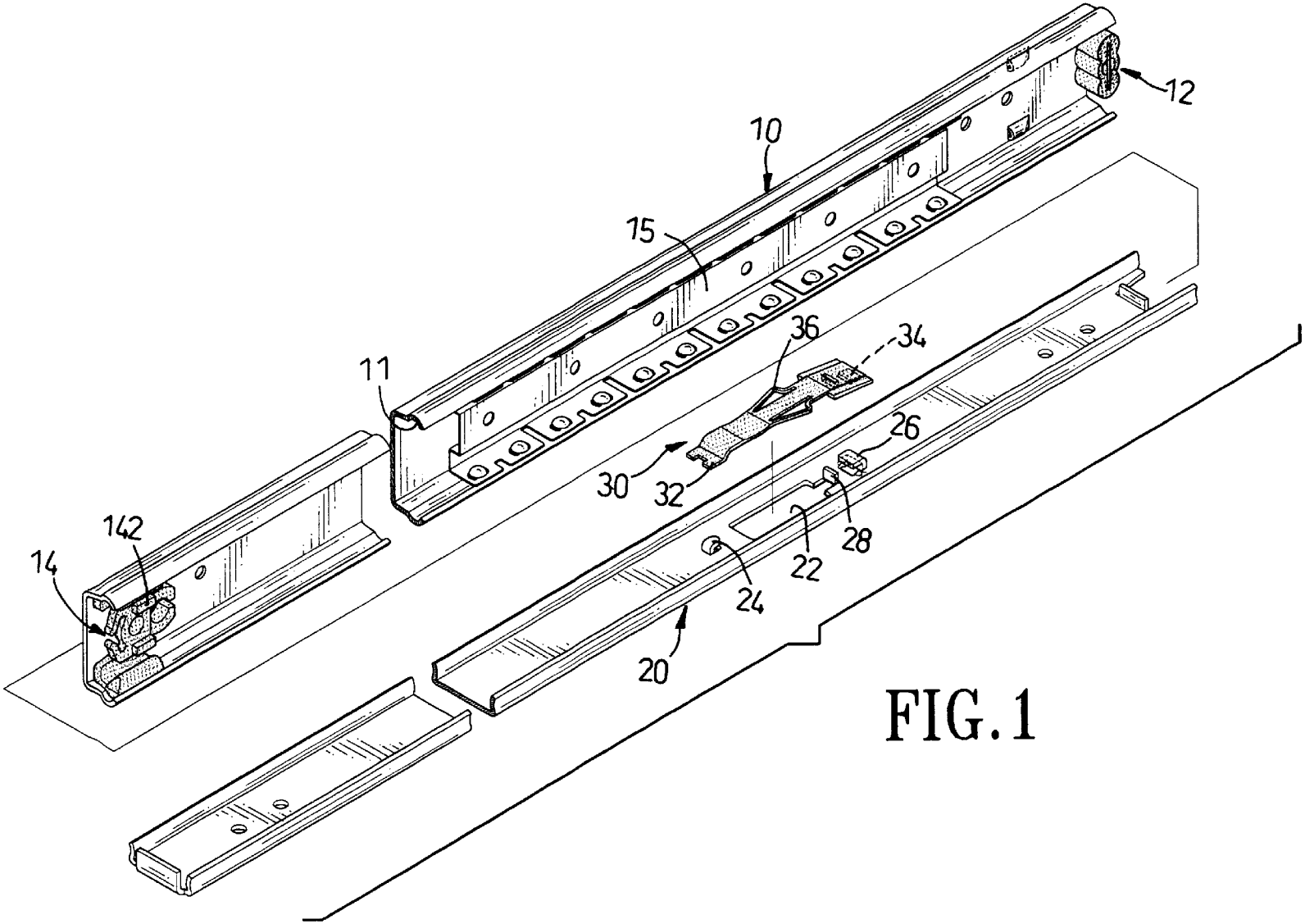
FIG. 1 is an exploded perspective view of a detachable drawer rail in accordance with the present invention.

With reference to FIG. 1, a detachable drawer rail is composed of a U-shaped track (10), a bearing race (15), a rail (20) and a resilient latch (30).

The track (10) is adapted to be secured on an inner side face of a compartment in furniture and has two guides (11) defined respectively on two side-walls of the track (10). A limit tab (12) is formed on one end of the track (10) and a limit block (14) is secured on the other end of the track (10). The limit block (14) is made of resilient material such as rubber and has two locking protrusions (142) formed perpendicular to the limit block (14)and respectively on opposite sides of the limit block (14).

The bearing race (15) is substantially U-shaped and movably mounted on inner faces of the track (10) to allow the rail (20) to slide fluently with the track (10).

Figure 2:
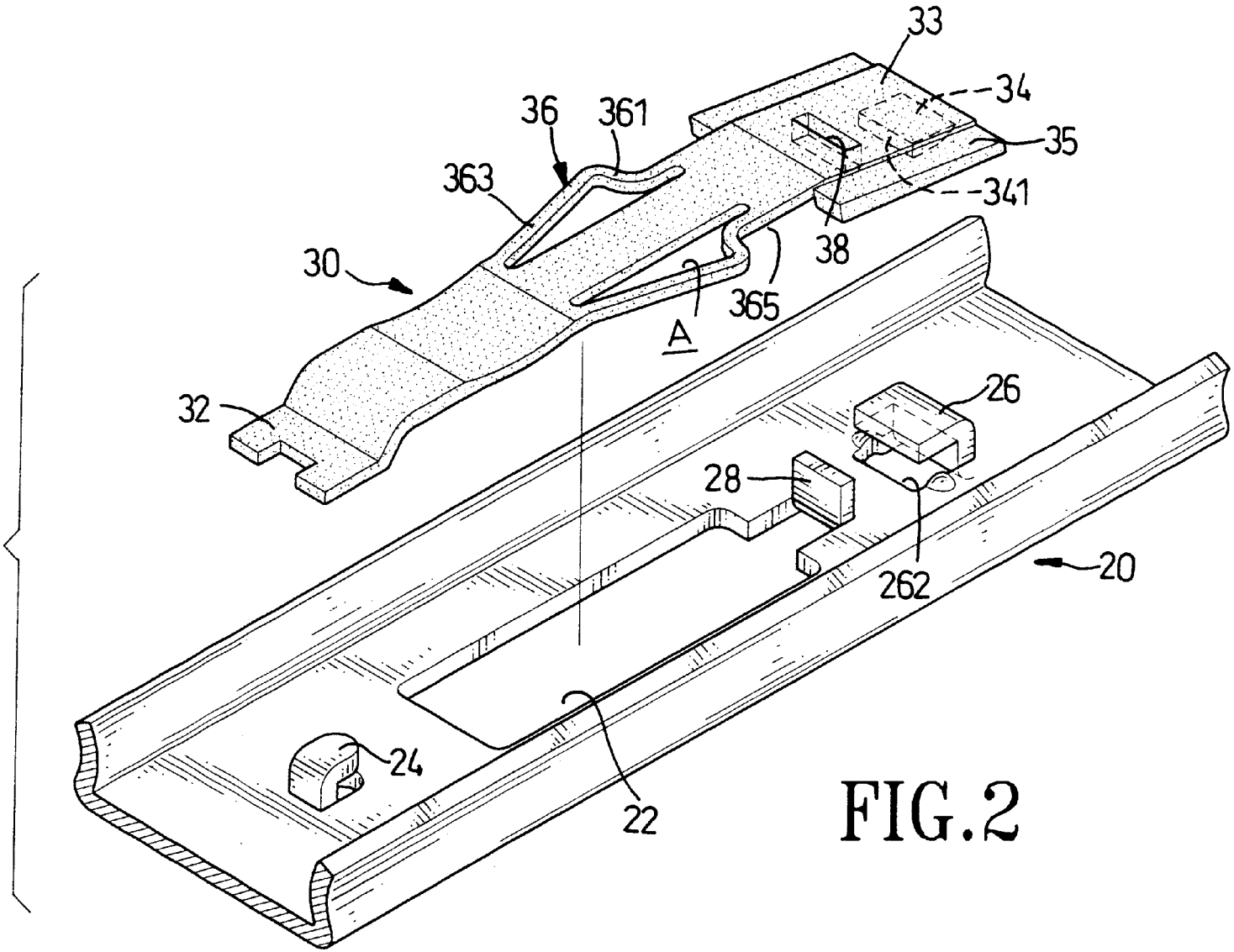
FIG. 2 is an enlarged perspective view of a resilient latch and a segment of a rail in accordance with FIG. 1.

With reference to FIGS. 1 and 2, the rail (20) is adapted to be secured to a side-wall of a drawer and has an opening (22) defined in a middle portion of the rail (20). An attachment hook (24) and a locking block (26) are formed on opposite sides of the opening (22). A recess (262) is defined in the rail (20) near a base of the locking block (26). Additionally, a tongue (28) is formed on the rail (20) and protrudes toward the track (10).

The resilient latch (30) is a strip which has a fork (32) formed at one end and an inclined surface (33) formed at the other end. A nub (34) having an abutment face (341) is formed under the inclined surface (33) and a wing (35) protrudes laterally from each side of the inclined surface (33). A groove (38) corresponding to the tongue (28) of the rail (20) is defined in the inclined surface (33) of the resilient latch (30). Additionally, a resilient ear (36) is formed laterally from each side of a middle portion of the resilient latch (30) and constructs a gap (A) between the middle portion. Each resilient ear (36) is divided into a locking portion (361) and a guiding portion (363). The locking portion (361) is an arc and constructs a port (365) between it and the wing (35). The guiding portion (363), which is a long strip, inclines inwardly to a direction of the end where the fork (32) is formed.

Figure 3:
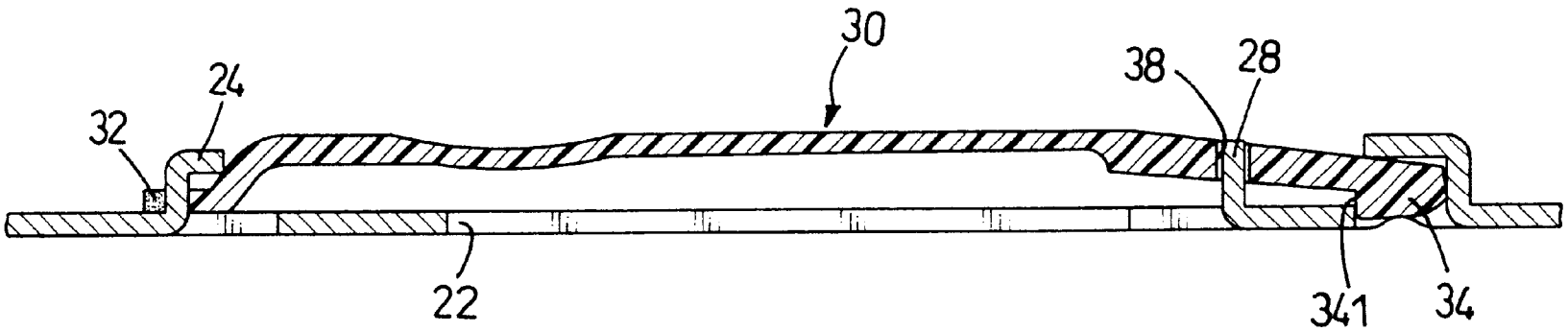
FIG. 3 is an enlarged cross-sectional side plan view of the resilient latch and rail segment in combination.

With reference to FIG. 3, the resilient latch (30) is attached to the rail (20) by mating the fork (32) to the attachment hook (24) of the rail (20) and forcing the nub (34) under the inclined surface (33) into the recess (262). Additionally, the tongue (28) of the rail (20) is wedged into the groove (38) to enhance a positioning efficiency of attaching the resilient latch (30) to the rail (20). The abutment face (341) flatly and evenly contacts an inner wall of the recess (262) so that the resilient plate (30) is not rocked easily when the rail (20) slides on the track (10).

Figure 4:
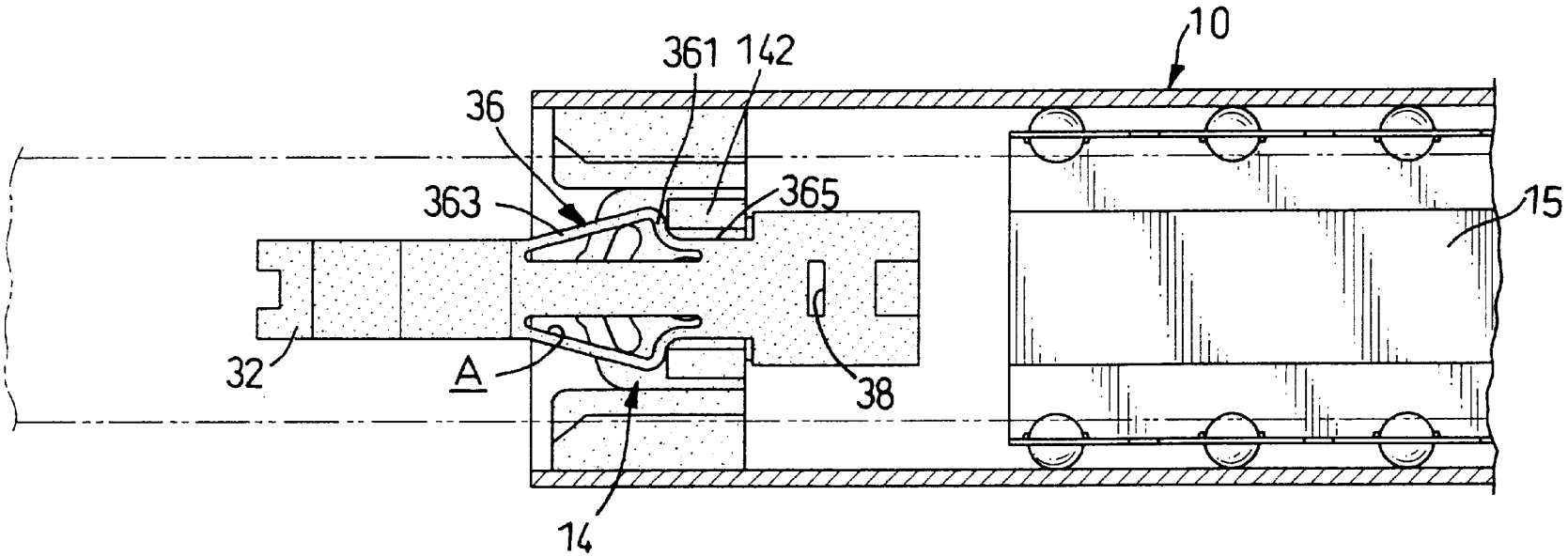
FIG. 4 is an enlarged top plan view in partial section of the detachable drawer rail when resilient ears are pressed to pass between two locking protrusions of a limit block.

When the rail (20) is pushed outwardly as shown in FIG. 4, the locking protrusions (142) of the lock block (14) slide along the guiding portions (363) and compress laterally the resilient ears (36). Therefore, the resilient ears (36) are deformed into the gap (A) to make the resilient latch (30) pass between the locking protrusions (142). Then, each locking protrusion is retained in the port (365) between the wing (35) and the locking portion (361) of the resilient ear (36) so that the rail (20) is kept in a fixed position.

Figure 5:
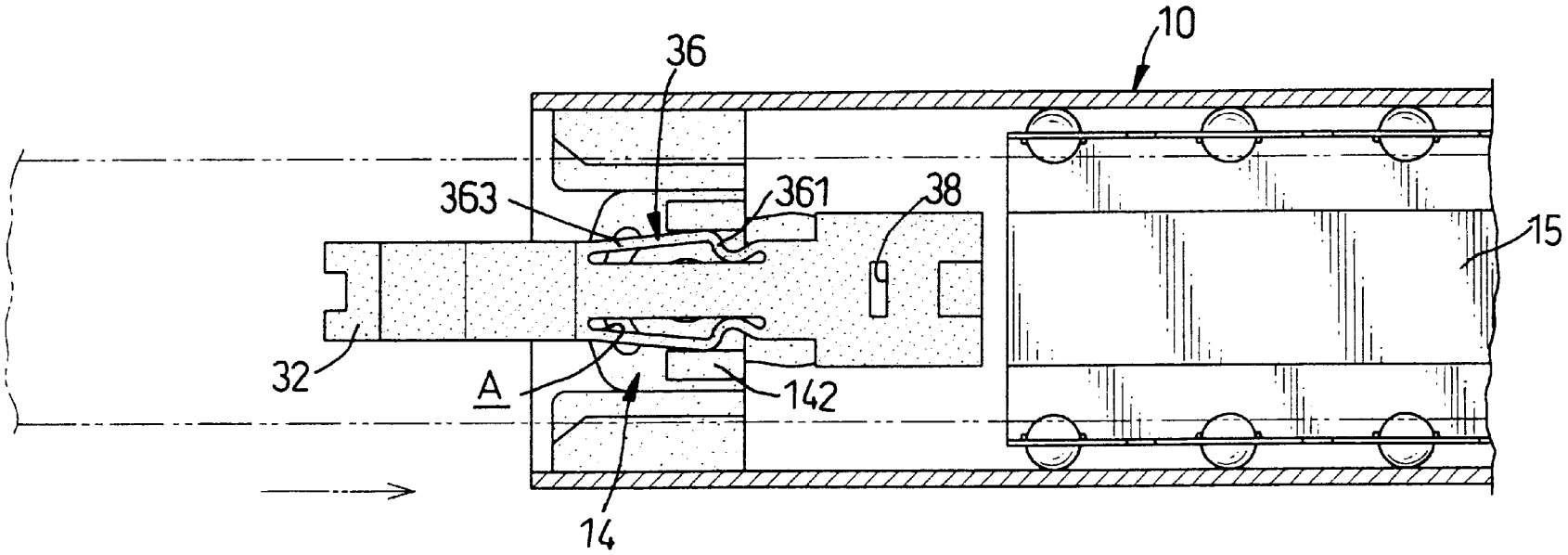
FIG. 5 is an enlarged top plan view in partial section of the detachable drawer rail when the locking protrusions are retained inside ports.
Figure 6:
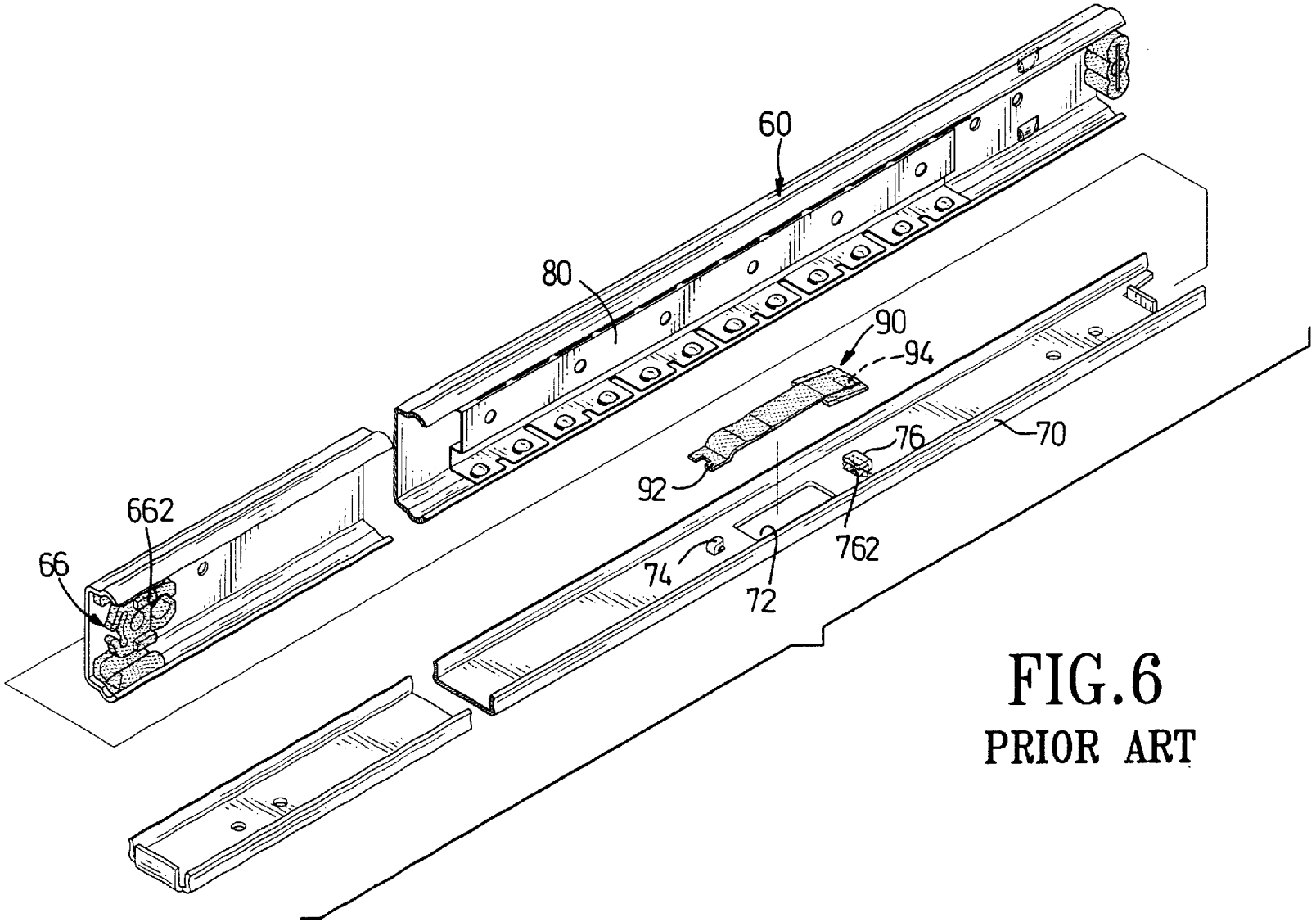
FIG. 6 PRIOR ART
FIG. 6 is an exploded perspective view of a first conventional detachable drawer rail in accordance with the prior art.
Figure 7:
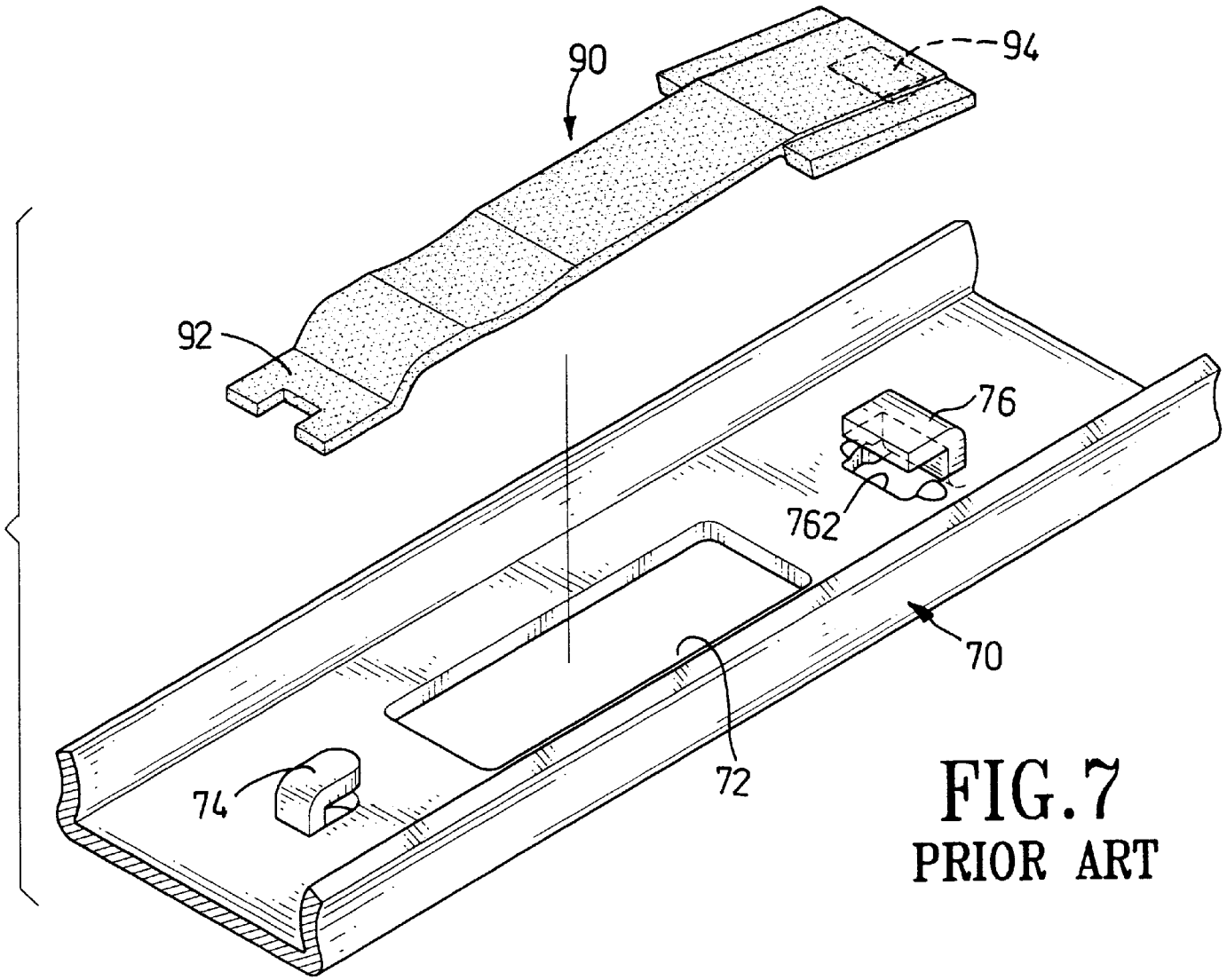
FIG. 7 PRIOR ART
FIG. 7 is an enlarged perspective view of a resilient plate and a segment of a rail in accordance with FIG. 6.
Figure 8:
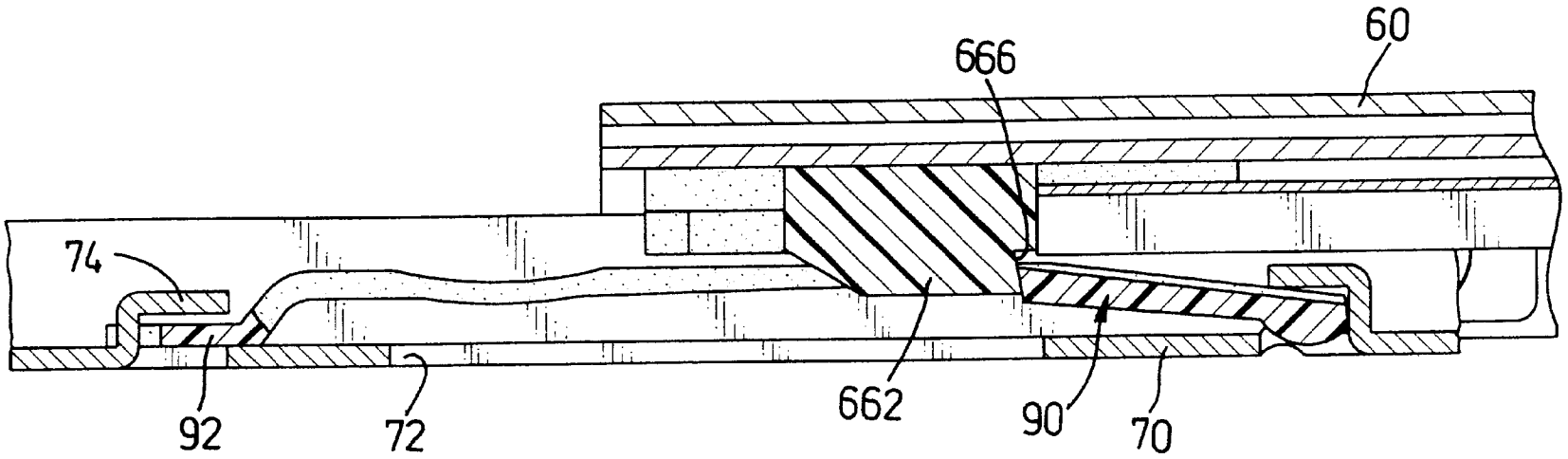
FIG. 8 PRIOR ART
FIG. 8 is an enlarged cross-sectional side plan view of the first conventional drawer rail when the resilient plate resists a locking protrusion.
Figure 9:
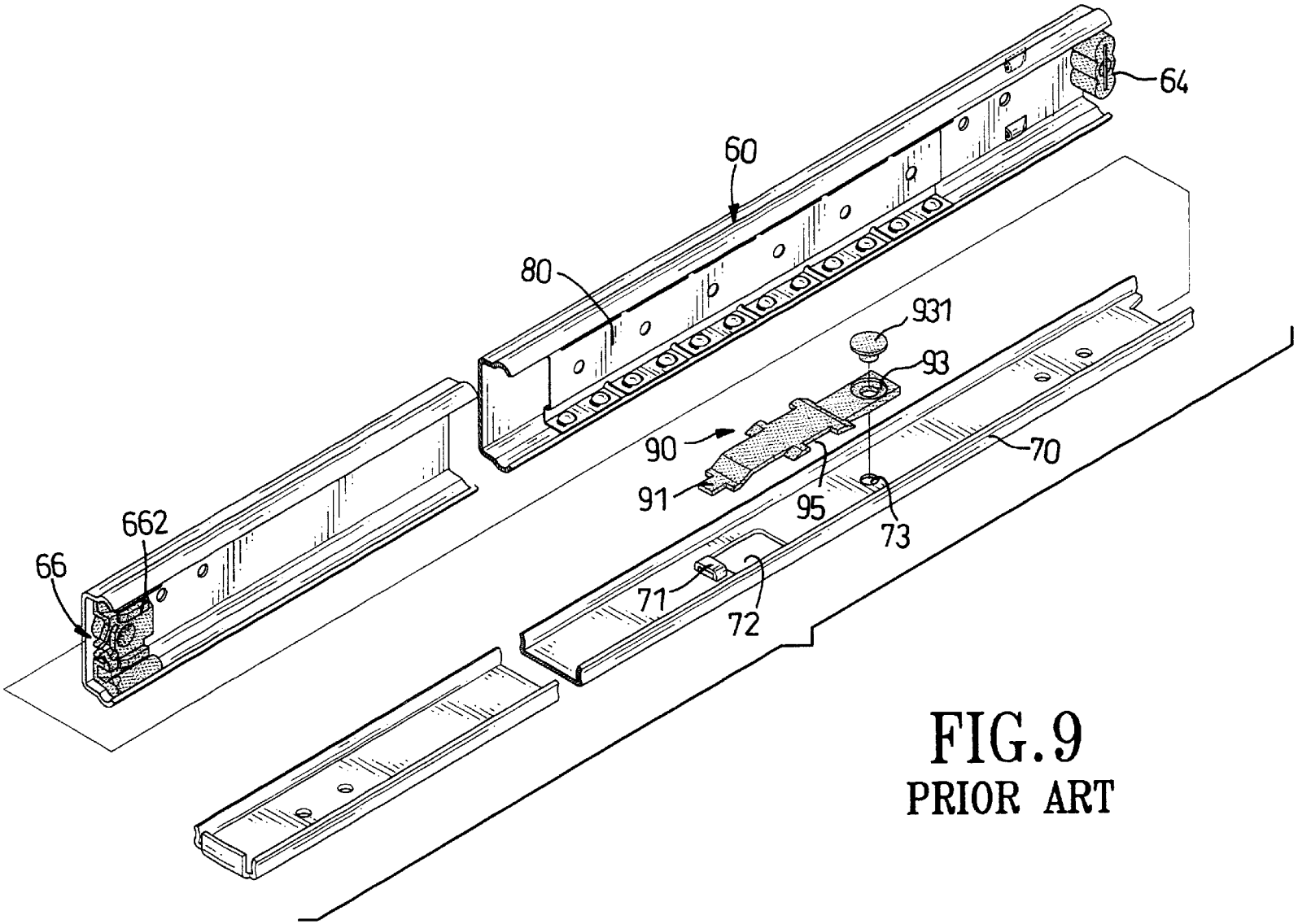
FIG. 9 PRIOR ART
FIG. 9 is exploded perspective view of a second conventional detachable drawer rail in accordance with the prior art.
Figure 10:
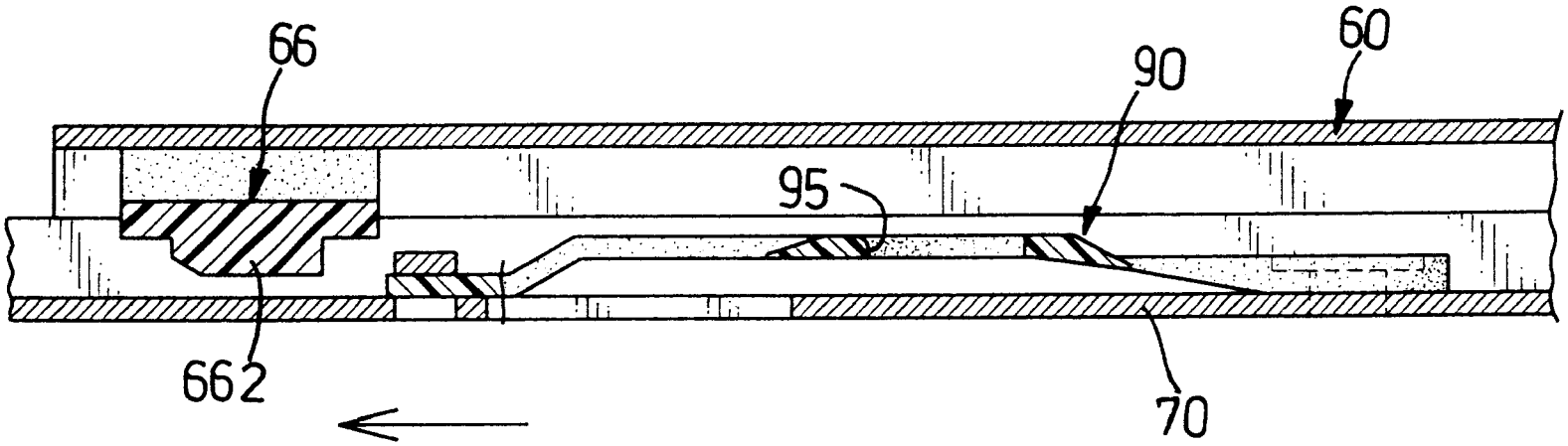
FIG. 10 PRIOR ART
FIG. 10 is an enlarged cross-sectional side view of the second conventional detachable drawer rail when the rail is pulled outward.
Figure 11:
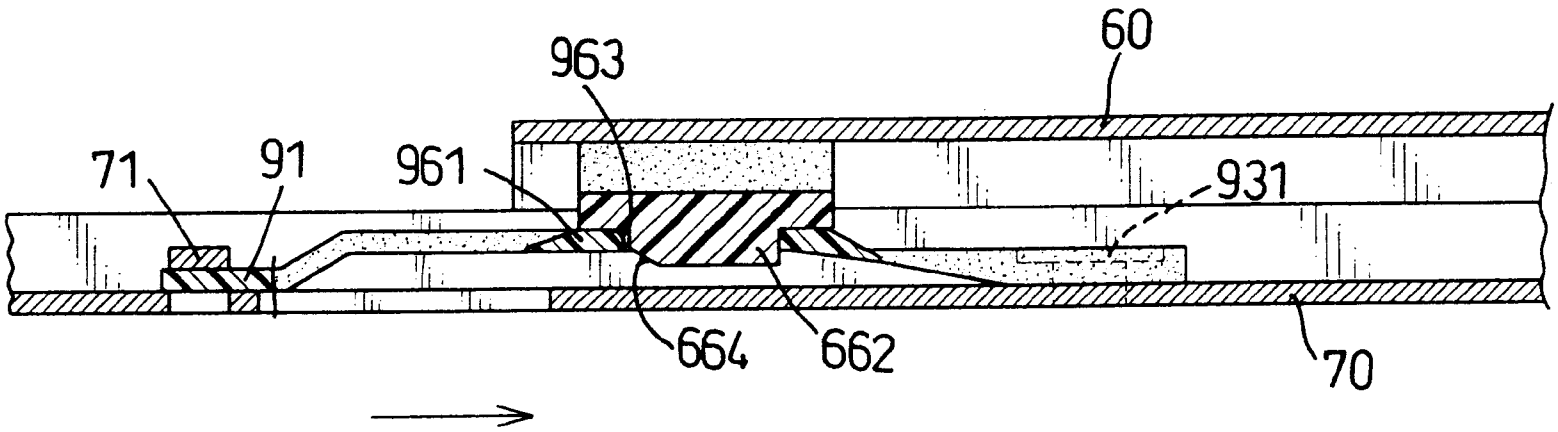
FIG. 11 PRIOR ART
FIG. 11 is an enlarged cross-sectional side view of the second conventional detachable drawer rail when the rail is pushed inwardly.

When the rail (20) is pulled inwardly to release from the fixed position as shown in FIG. 5, the locking protrusions (142) press the resilient ears (36) again at the locking portions (361) and then overcome the arc so as to make the locking protrusions (142) become released from the port (35) of the resilient latch (30).

According to the above description, it is easy to be understood that the resilient ears (36) of the resilient latch (30) provide a retaining efficiency so as to keep the locking protrusions inside the ports (35). The gaps (A) make the resilient ears (36) deformed easily and laterally so that the resilient latch (30) is not easily damaged when the resilient ears (36) rub against the locking protrusion (142).

Additionally, the tongue (28) of the rail (20) mated with the groove (38) enhances the positioning efficiency of attaching the resilient latch (30) to the rail (20). The nub (34) having the abutment face (341) contacts the inner wall of the recess (262) to provide a stable efficiency to avoid the resilient latch (30) rocking and falling from the rail (20).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A detachable drawer rail comprising:

a track (10) adapted to be secured on a furniture item to retract a drawer inside the furniture item and the track (10) having a limit block (14) secured on the track (10), wherein the limit block (14) has a locking protrusion formed on opposite sides of the limit block (14);

a rail (20) adapted to be firmly attached to the drawer and slidably mounted on the track (10); and a resilient latch (30) attached to the rail (20) and comprising a port (365) defined in the resilient latch (30)

a resilient ear (36) adjacent to the port (365) and formed laterally on each side of the resilient latch (30), each resilient ear (36) constructing a gap (A) with the resilient latch (30) and comprising a locking portion (361) of an arc formed at one side of the resilient ear (36) to block the locking protrusion (142) within the port (365); and a guiding portion (363) of a long strip connected to the locking portion (361) and formed at the other side of the resilient ear (36) to guide the locking protrusion (142) when the drawer is pulled outwardly;

wherein the gap (A) defined between the resilient latch (30) and the resilient ear (36) makes the resilient ear (36) laterally retract when the resilient latch (30) passes between the locking protrusions (142) of the limit block.

2. The detachable drawer rail as claimed in claim 1, wherein the rail (20) further comprises a recess (262) defined in the rail (20) and the resilient latch (30) further comprises a nub (34) under the resilient latch (30) to mate with the recess (262) and make the resilient latch (30) fixed on the rail (20).

3. The detachable drawer rail as claimed in claim 2, wherein the nub (34) of the resilient latch (30) has an abutment face (341) to contact with an inner wall of the recess (262) so that the resilient latch (30) is not easily rocked when the rail (20) slides.

4. The detachable drawer rail as claimed in claim 3, wherein the rail (20) further has a tongue (28) formed on the rail (20) and the resilient latch (30) further has a groove (38) to mate with the tongue (28) so as to enhance a positioning effect of attaching the resilient latch (30) to the rail (20) when the tongue (28) is wedged into the groove (38).

5. The detachable drawer rail as claimed in claim 2, wherein the rail (20) further has a tongue (28) formed on the rail (20) and the resilient latch (30) further has a groove (38) to mate with the tongue (28) so as to enhance a positioning effect of attaching the resilient latch (30) to the rail (20) when the tongue (28) is wedged into the groove (38).

6. The detachable drawer rail as claimed in claim 1, wherein the rail (20) further has a tongue (28) formed on the rail (20) and the resilient latch (30) further has a groove (38) to mate with the tongue (28) so as to enhance a positioning effect of attaching the resilient latch (30) to the rail (20) when the tongue (28) is wedged into the groove (38).

* * * * *